US011828565B2

(12) United States Patent
Barnett

(10) Patent No.: US 11,828,565 B2
(45) Date of Patent: Nov. 28, 2023

(54) REPEATING TOY CROSSBOW

(71) Applicant: Barnett Outdoors, LLC, Tarpon Springs, FL (US)

(72) Inventor: David A Barnett, Tampa, FL (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 17/727,086

(22) Filed: Apr. 22, 2022

(65) Prior Publication Data

US 2022/0341698 A1 Oct. 27, 2022

Related U.S. Application Data

(60) Provisional application No. 63/178,744, filed on Apr. 23, 2021.

(51) Int. Cl.
*F41B 5/14* (2006.01)
*F41B 5/12* (2006.01)

(52) U.S. Cl.
CPC ..... *F41B 5/126* (2013.01); *F41B 5/1469* (2013.01)

(58) Field of Classification Search
CPC ..... F41B 5/12; F41B 5/126; F41B 5/1469; F41B 7/08; F41B 11/50; F41B 11/51; F41B 11/89; F41A 9/72; F41A 9/74; F41A 9/22; F41A 9/23; A63F 2009/0269
See application file for complete search history.

(56) References Cited

U.S. PATENT DOCUMENTS 2,918,050 A * 12/1959 Kopman ..... F41B 5/12 124/40
3,721,248 A * 3/1973 Paynter ..... A24C 5/42 131/72

(Continued)

FOREIGN PATENT DOCUMENTS

CN 201413078 2/2010
CN 209945131 * 1/2020 ..... F41B 5/12

(Continued)

OTHER PUBLICATIONS

Co-pending U.S. Appl. No. 17/745,961, filed May 17, 2022, titled "Repeating Break Action Crossbow."

(Continued)

*Primary Examiner* — John E Simms, Jr.
(74) *Attorney, Agent, or Firm* — Jones Walker LLP

(57) ABSTRACT

A repeating crossbow having a pump-action reloading mechanism. The crossbow includes an elongated body with a shooting track and a holding chamber configured to house one or more projectiles. A hatch is coupled to the body and configured to move between a first position aligned with the shooting track and a second position at least partially aligned with the holding chamber. A palm rest is slidingly connected to the elongated body. Sliding the palm rest in a rearward direction causes the hatch to move from the first position into the second position. A biasing member within the holding chamber ejects a projectile onto the hatch. Sliding the palm rest in a forward direction to return to its default position causes the hatch to return to its first position, bringing the projectile into alignment with the shooting track.

23 Claims, 12 Drawing Sheets

(56) References Cited

U.S. PATENT DOCUMENTS

| | | | | |
|---|---|---|---|---|
| 4,565,182 | A * | 1/1986 | Barnett | F41B 5/12 124/48 |
| 5,119,575 | A * | 6/1992 | Gajdica | F41A 9/72 42/49.01 |
| 5,544,641 | A * | 8/1996 | Jenn | F41G 1/467 124/52 |
| 9,528,792 | B1 | 12/2016 | Chang | |
| 9,568,269 | B1 | 2/2017 | Chang | |
| 9,746,278 | B1 | 8/2017 | Chang | |
| 9,766,032 | B1 | 9/2017 | Chang | |
| 10,378,853 | B1 * | 8/2019 | Liu | F41B 5/1469 |
| 10,495,403 | B1 * | 12/2019 | Liu | F41B 5/143 |
| 10,663,249 | B1 * | 5/2020 | Liu | F41B 5/126 |
| 2008/0141989 | A1 * | 6/2008 | Ogawa | F41B 5/12 124/25 |
| 2017/0328657 | A9 * | 11/2017 | Dove | F41A 9/65 |
| 2018/0010376 | A1 * | 1/2018 | Beattie | E05D 11/1014 |
| 2019/0107358 | A1 * | 4/2019 | Spielberger | F41B 7/006 |
| 2022/0113106 | A1 * | 4/2022 | Blackstock | F41B 5/126 |

FOREIGN PATENT DOCUMENTS

| | | | | |
|---|---|---|---|---|
| EP | 0428344 | * | 5/1991 | F41B 7/08 |
| GB | 867502 | * | 12/1964 | F41A 9/23 |

OTHER PUBLICATIONS

International Search Report and Written Opinion dated Aug. 1, 2022, from Applicant's counterpart International Patent Application No. PCT/US2022/25975.

* cited by examiner

REPEATING TOY CROSSBOW

CROSS-REFERENCE TO RELATED APPLICATION

This application claims the benefit of, and priority to, U.S. Provisional Patent Application No. 63/178,744, filed on Apr. 23, 2021, which is incorporated herein by reference in its entirety.

FIELD OF THE INVENTION

This invention relates to weapons. More specifically, it relates to a repeating toy crossbow configured to be reloaded via a pump-action reloading mechanism.

BACKGROUND

The current marketplace has several models of toy crossbows that shoot sucker darts. However, toy crossbows currently known in the art have several major drawbacks that diminish the quality of the user experience and enjoyment. The first disadvantage pertains to the step of pulling back the string. Currently known toy crossbows require the user to either manually pull back the string behind the trigger area, which can be a strenuous and monotonous activity, or to pull the string using one or more hooks, which then must be manually returned to the front of the crossbow to clear the string area prior to taking a shot. The second disadvantage of currently known toy crossbows pertains to loading a dart onto the shooting track: the user must manually position a single dart onto the track after cocking the crossbow and then repeating this task for each subsequent shot. The steps of manually pulling the string and placing a dart onto the track are detrimental to the user experience because these manual steps decrease the rate at which the user can fire consecutive shots, require the user to lose aim after every shot, and require the user to keep track of the whereabouts of the spare darts and needing to manually reach for those darts to reload the crossbow after every shot.

Accordingly, what is needed is a repeating toy crossbow that enables the user to quickly and efficiently pull back the string and reload the crossbow with a dart in one swift satisfying motion without losing the aim on the target.

BRIEF DESCRIPTION OF THE DRAWING VIEWS

DETAILED DESCRIPTION OF SELECTED EMBODIMENTS

In the following detailed description of the preferred embodiment, reference is made to the accompanying drawings, which form a part hereof, and within which specific embodiments are shown by way of illustration by which the invention may be practiced. It is to be understood that other embodiments may be utilized and structural changes may be made without departing from the scope of the invention.

Disclosed herein is a repeating crossbow including a shooting track and a holding chamber that is configured to house one or more projectiles. A selectively movable hatch allows access to an opening of the holding chamber for loading projectiles into the holding chamber and automatically ejecting a projectile from the holding chamber onto the hatch under certain conditions. The hatch transitions between a first position in which a leading edge of the hatch is aligned with the shooting track (i.e., a closed position) and a second position in which the leading edge of the hatch is aligned with the opening of the holding chamber (i.e., an open position). The holding chamber is configured to eject a single projectile onto the hatch when the hatch is placed in the second position with no projectile currently positioned on the hatch and at least one projectile positioned in the holding chamber. A sliding palm rest is configured to move the hatch between the first position and the second position. In some embodiments, the sliding palm rest also cocks the repeating crossbow by drawing a string of the crossbow in a rearward direction from an initial position into a cocked position. In certain embodiments, the repeating crossbow also includes a projectile retention assembly secured above the shooting track. The projectile retention assembly may include a hood, which may be pivotally connected to a body of the crossbow. FIGS. 1-12 illustrate embodiments of the repeating crossbow disclosed herein, with many other embodiments within the scope of the claims being readily apparent to skilled artisans after reviewing this disclosure.

Figure 1:
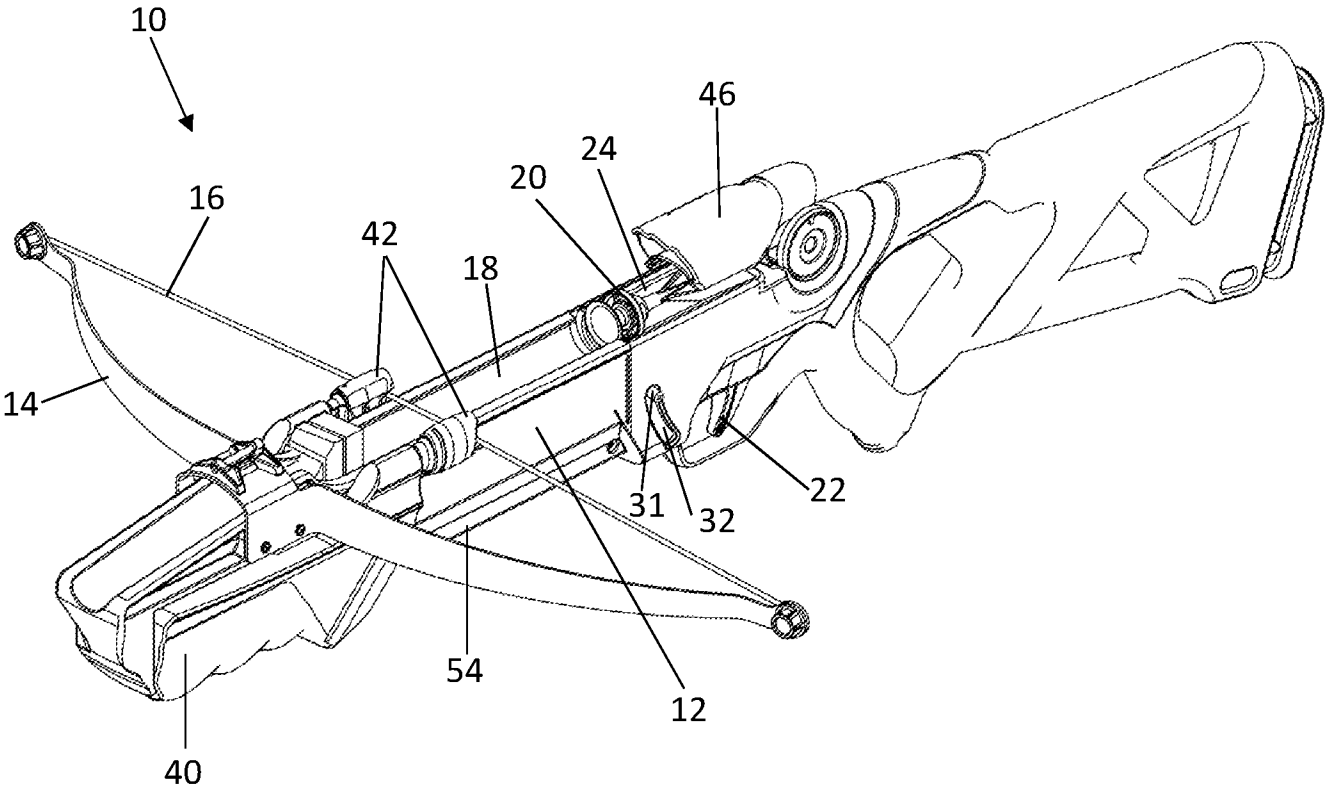
FIG. 1 is a perspective view of a repeating crossbow of the present invention.

FIG. 1 depicts a perspective view of one embodiment of the repeating crossbow. Crossbow 10 includes elongated body 12, prod 14 secured to a forward portion of elongated body 12, and string 16 extending between the ends of prod 14. FIG. 1 shows string 16 in an initial position. When string 16 is pulled in a rearward direction into a cocked position, prod 14 undergoes an elastic deformation. The elastic deformation of prod 14 results in potential energy being stored in prod 14 and string 16 in the cocked position. The top surface of elongated body 12 of crossbow 10 includes shooting track 18. As used herein, "shooting track" and "track" each mean a top surface of a crossbow body configured to allow travel of a sucker dart while being launched from the crossbow.

After string 16 is placed in the cocked position, sucker dart 20 may be placed onto shooting track 18. When a user pulls trigger 22, string 16 is released and travels along shooting track 18 to return to the initial position shown in FIG. 1. As string 16 travels along shooting track 18, the potential energy stored in the prod-string assembly is converted into kinetic energy, which is transferred to sucker dart 20, thereby propelling sucker dart 20 along shooting track 18 and shooting sucker dart 20 out of crossbow 10.

Figure 2:
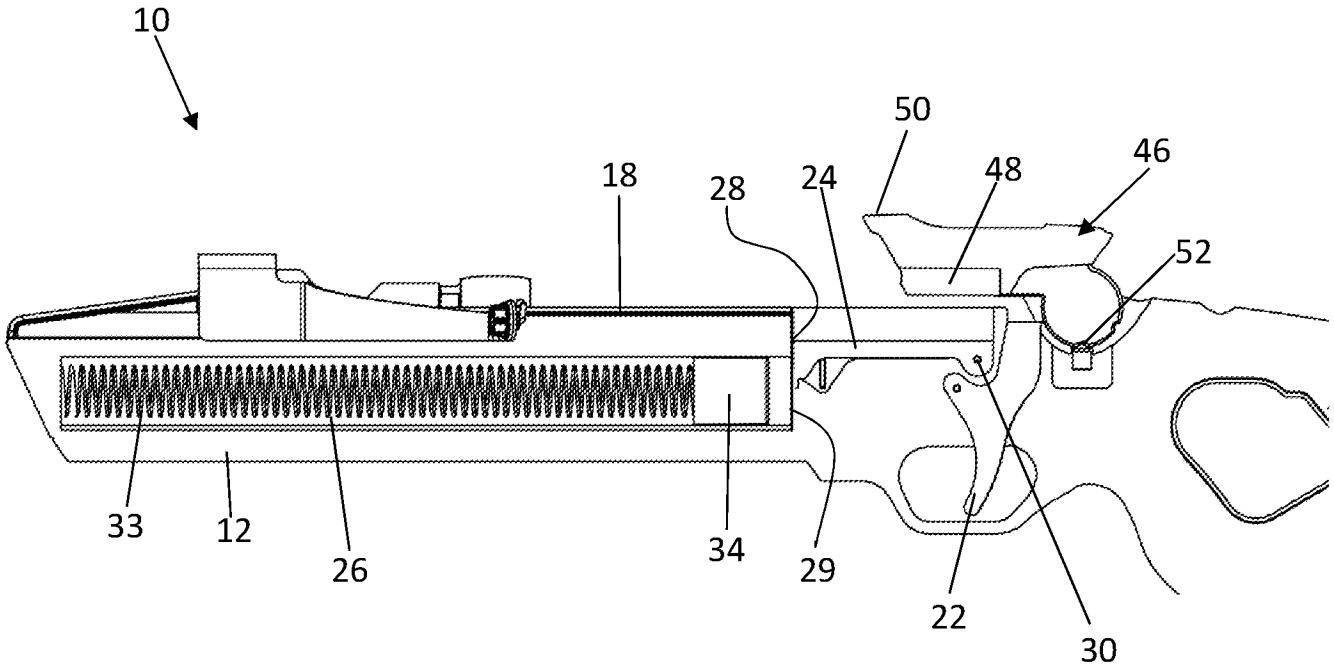
FIG. 2 is a partial cut-away view of the repeating crossbow in a default position.

With reference now to FIGS. 1 and 2, crossbow 10 also includes hatch 24 and holding chamber 26. Holding chamber 26 is configured to house one or more projectiles (e.g., sucker darts) therein. Hatch 24 is configured to allow access to holding chamber 26. In certain embodiments, holding chamber 26 is generally parallel to shooting track 18. In some embodiments, holding chamber 26 is disposed within an internal portion of elongated body 12. In certain embodiments, holding chamber 26 is disposed below shooting track 18.

Leading edge 28 of hatch 24 is configured to move between a first position (i.e., a closed position) in which leading edge 28 is aligned with shooting track 18 and a second position (i.e., an open position) in which leading edge 28 is aligned with opening 29 of holding chamber 26. In this way, leading edge 28 of hatch 24 is configured to move downward relative to shooting track 18. For example, hatch 24 may be pivotally attached to elongated body 12 about pivot point 30, which may include a hinge or pin connection. Alternatively, hatch 24 may be configured to slidingly retract below shooting track 18 without pivoting while maintaining a horizontal orientation, as readily understood by a person of skill in the art. In certain embodiments, hatch 24 may be spring-loaded and biased toward the closed position (shown in FIG. 2). Hatch pin 31 of hatch 24 may extend through hatch pin slot 32 in a side wall of elongated housing 12. The length of hatch pin 31 may exceed the depth of hatch pin slot 32, such that hatch pin 31 partially protrudes outside of hatch pin slot 32. Hatch pin slot 32 may be configured to allow hatch pin 31 to move with hatch pin slot 32 as hatch 24 moves between the first position and the second position.

In one embodiment, biasing member 33 and block 34 may be disposed within holding chamber 26, with block 34 connected to a distal end of biasing member 33. Biasing member 33 and block 34 are configured to bias one or more projectiles positioned within holding chamber 26 toward opening 29 of holding chamber 26. Biasing member 33 may be any type of spring, such as a coil spring.

Crossbow 10 may further include palm rest 40, which is configured to slide along a lower side of elongated body 12. In certain embodiments, palm rest 40 may be configured to cause hatch 24 to move between the first position and the second position. For example, sliding palm rest 40 in a rearward direction may cause hatch 24 to move from the first position into the second position, while sliding palm rest 40 in a forward direction may cause hatch 24 to return to the first position. Additionally, in certain embodiments, sliding palm rest 40 may be configured to move string 16 from the initial position into the cocked position. For example, string dampeners 42 attached to or integrally formed with palm rest 40 may be configured to engage string 16 and move string 16 into the cocked position. In certain embodiments, crossbow 10 may include a stationary palm rest in addition to sliding palm rest 40.

Figure 3:
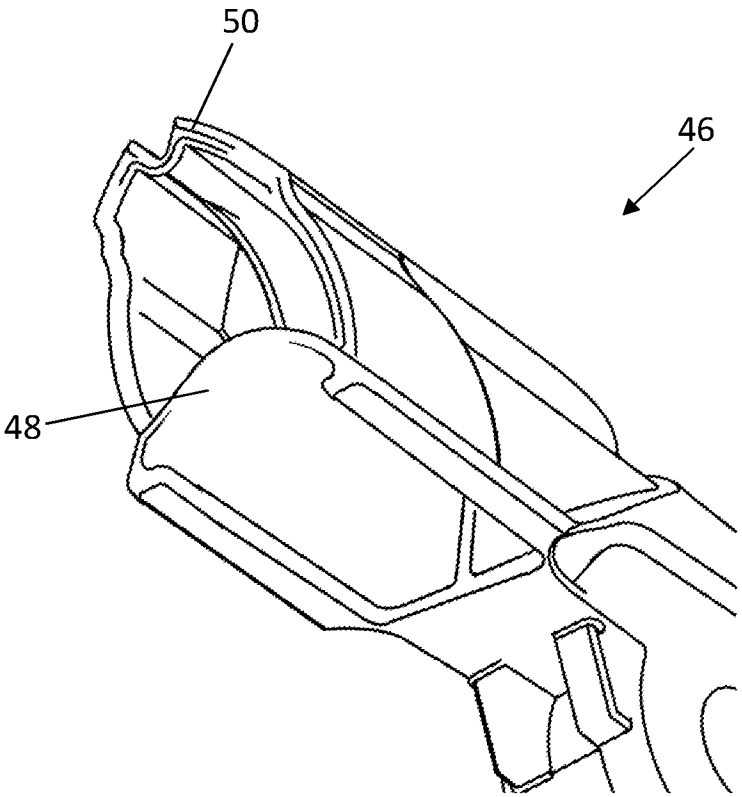
FIG. 3 is a perspective view of a projectile retention assembly of the repeating crossbow.

Referring now to FIGS. 1-3, crossbow 10 may further include projectile retention assembly 46 positioned above hatch 24. Projectile retention assembly 46 may include hood 48 and sight 50. Hood 48 is configured to retain a projectile in place on hatch 24. The projectile retention assembly 46 may be configured to move away from hatch 24. For example, projectile retention assembly 46 may be configured to pivot upward. Projectile retention assembly 46 may also include locking ball 52 configured to selectively retain projectile retention assembly 46 in either the closed position (shown in FIG. 1) or open position (shown in FIG. 4). Specifically, locking ball 52 may be secured within a receptacle of elongated body 12 and configured to engage one or more receptacles of projectile retention assembly 46 to secure it in a particular position. In alternate embodiments, projectile retention assembly 46 may be configured to pivot to a side of shooting track 18, slide backwards (e.g., on a dovetail), or be removable.

Figure 4:
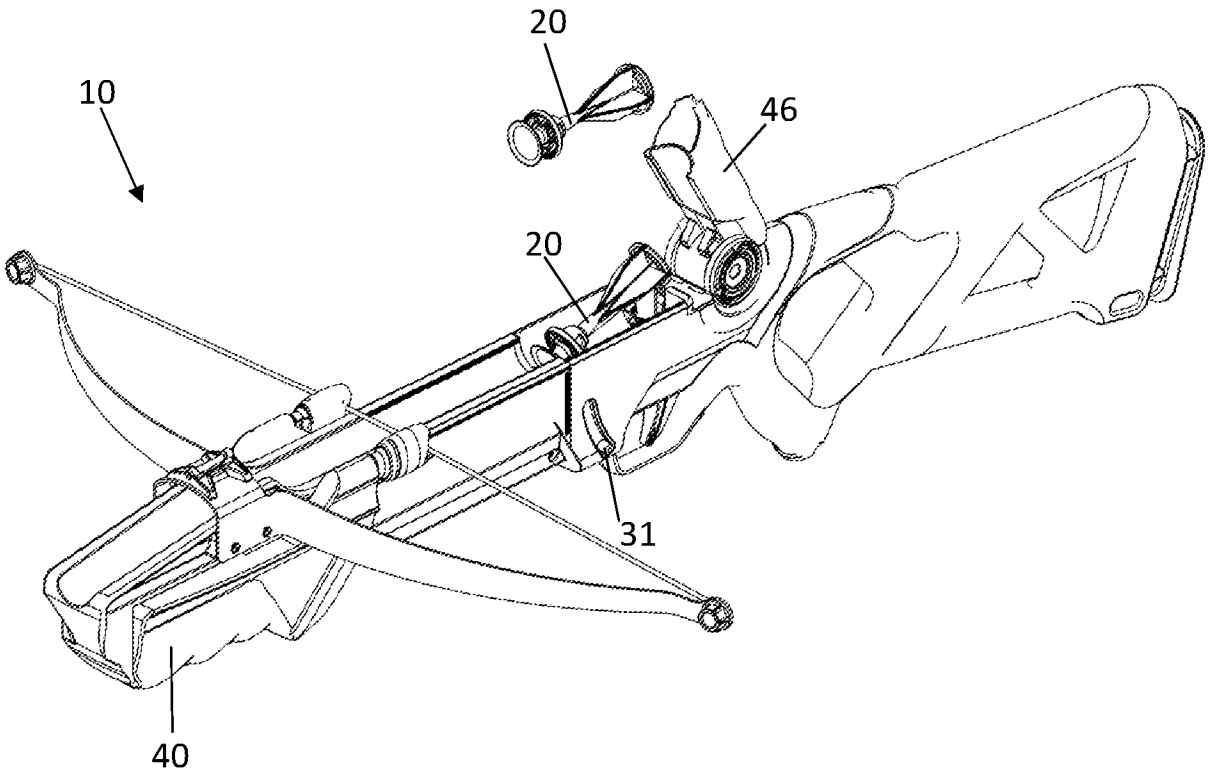
FIG. 4 is a perspective view of darts being loaded into a holding chamber of the repeating crossbow.
Figure 5:
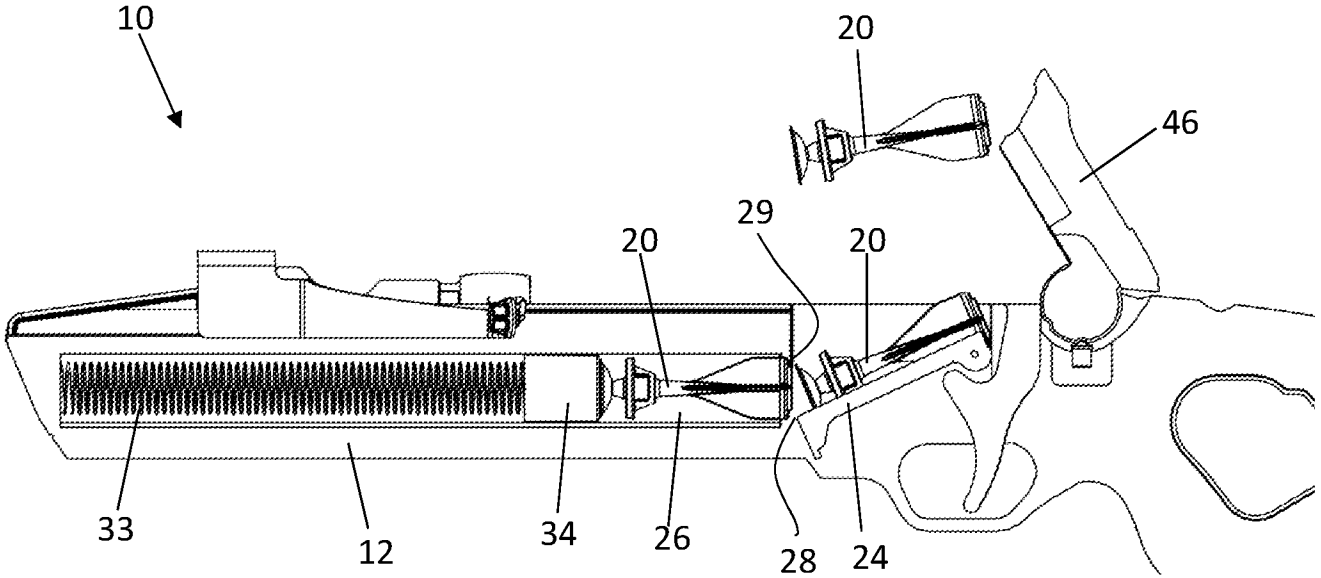
FIG. 5 is a partial cut-away view of the darts being loaded into the holding chamber.
Figure 6:
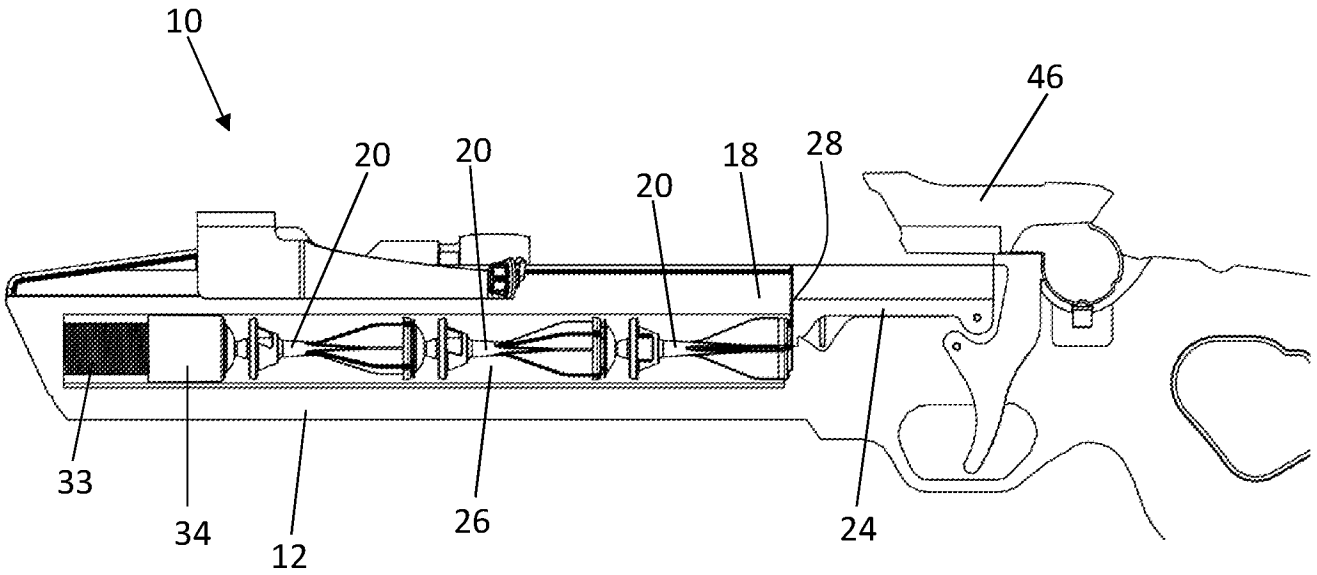
FIG. 6 is a partial cut-away view of multiple darts disposed within the holding chamber.

FIGS. 4-6 depict the process of loading sucker darts 20 into holding chamber 26 within elongated body 12 of repeating crossbow 10. First, a user may move projectile retention assembly 46 away from hatch 24, such as by rotating projectile retention assembly 46 from the closed position (shown in FIGS. 1-2) into the open position (shown in FIGS. 4-5). Then, a dart 20 may be placed onto hatch 24. Next, the user may apply a downward force on the dart to force hatch 24 to move from the first position (i.e., the closed position) into the second position (i.e., the open position) in which leading edge 28 of hatch 24 is aligned with opening 29 of holding chamber 26. With hatch 24 in the open position, the user may slide dart 20 into holding chamber 26 by applying a forward force on dart 20 that is sufficient to compress biasing member 33 within holding chamber 26. When the user releases the downward force, hatch 24 may return to the closed position in which leading edge 28 is aligned with shooting track 18, as shown in FIG. 6. The user may repeat this loading process to load additional darts 20 in holding chamber 26. Holding chamber 26 may be configured to house any number of projectiles, such as between 1 and 15 projectiles, such as sucker darts 20. When the loading process is complete, the user may move projectile retention assembly 46 into its closed position (shown in FIG. 6).

Figure 7:
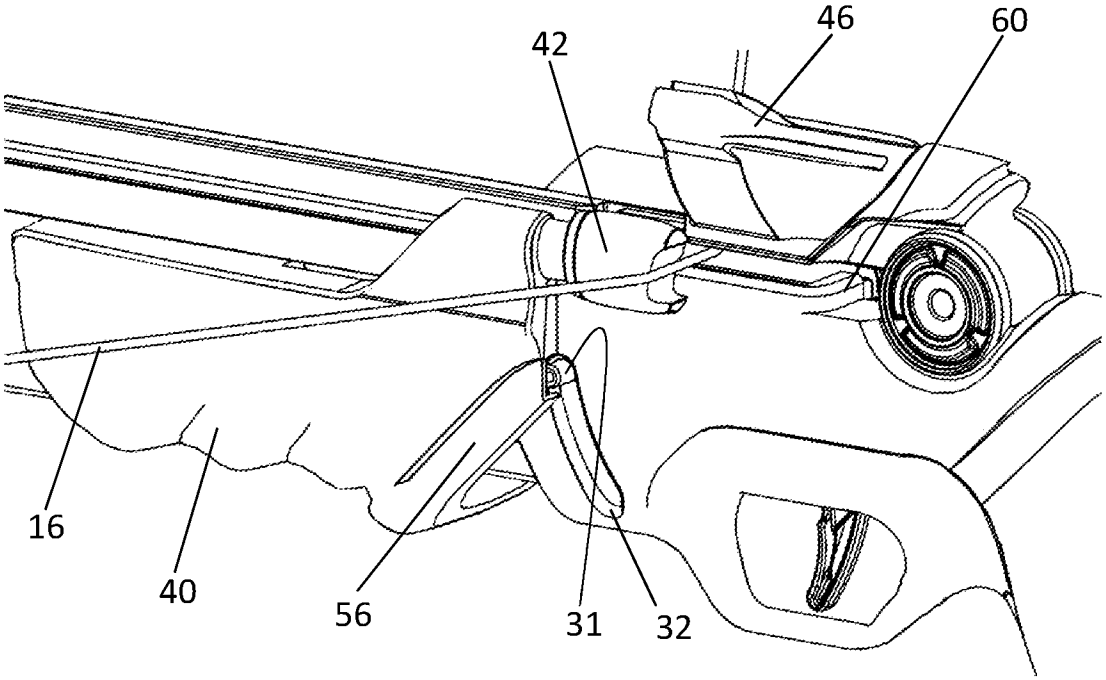
FIG. 7 is a partial perspective view of a palm rest of the repeating crossbow in a first engaged position.
Figure 8:
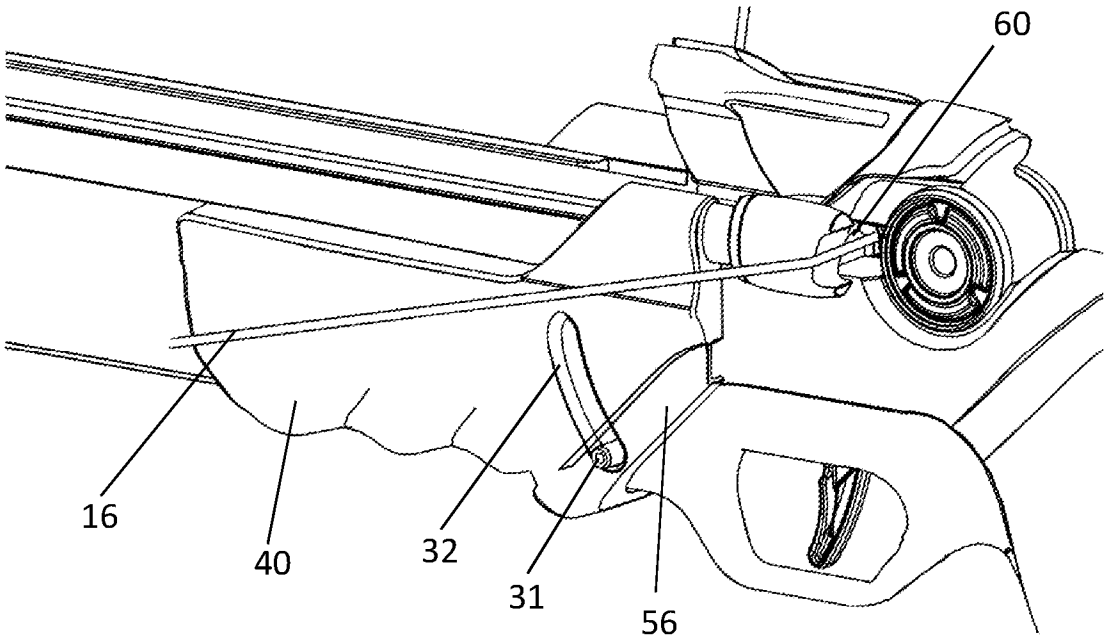
FIG. 8 is a partial perspective view of the palm rest in a second engaged position, with a bowstring engaging a string-retention ledge.

Referring to FIG. 7, a user may begin the process of cocking and loading repeating crossbow 10 with a dart 20 from holding chamber 26 by sliding palm rest 40 in a rearward direction from its default position near the forward end of elongated body 12 (shown in FIG. 1). Palm rest 40 may be configured to slide along longitudinal rail 54 of elongated body 12 (shown in FIG. 1). As palm rest 40 slides in the rearward direction, string dampeners 42 may engage string 16 and draw string 16 in the rearward direction with palm rest 40. When palm rest 40 reaches the first engaged position shown in FIG. 7, guide channel 56 of palm rest 40 may engage the portion of hatch pin 31 that protrudes beyond hatch pin slot 32. Guide channel 56 may extend in an opposite direction from the direction of hatch pin slot 32. In certain embodiments, a forward end of guide channel 56 may be lower than a rearward end of guide channel 56. With guide channel 56 engaging hatch pin 31, sliding palm rest 40 further in the rearward direction may cause hatch pin 31 to slide down within hatch pin slot 32, thereby causing hatch 24 to move from the first position (i.e., the closed position) toward the second position (i.e., the open position). When palm rest 40 reaches the second engaged position shown in FIG. 8, hatch pin 31 and hatch 24 are placed in the second position (i.e., the open position). Optionally, in this position, hatch pin 31 may be positioned at the lowest end of hatch pin slot 32. In the second engaged position of palm rest 40, string 16 may clear shooting track 18 and engage string-retention ledge 60, thereby placing string 16 and crossbow 10 in a cocked position.

Figure 9:
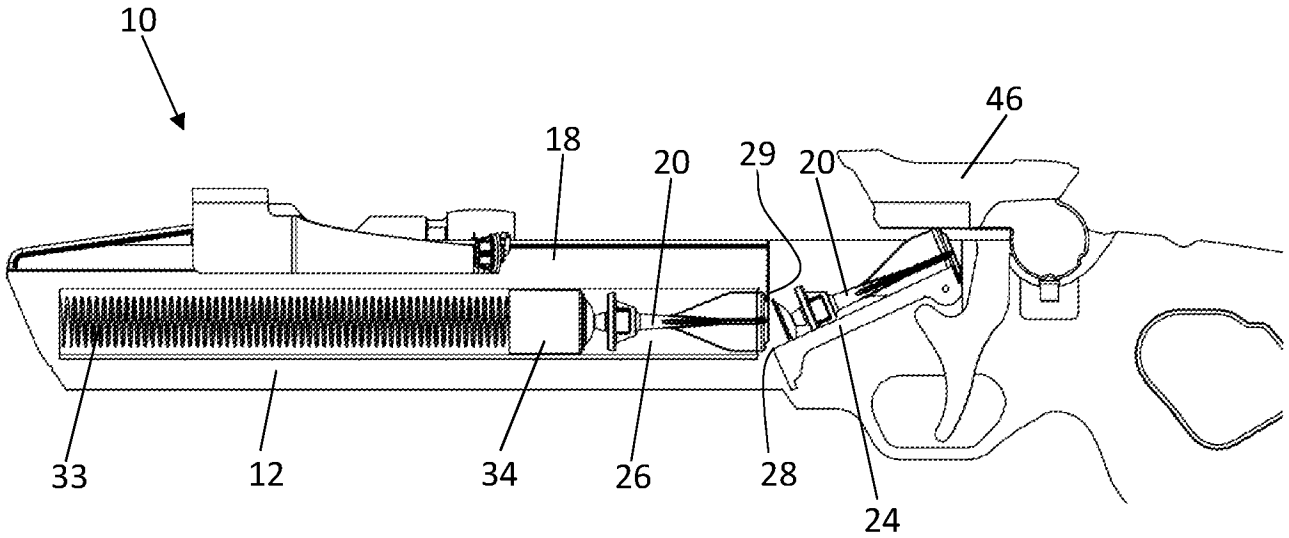
FIG. 9 is a partial cut-away view of the repeating crossbow when the palm rest is in the second engaged position.

With reference to FIG. 9, when the leading edge 28 of hatch 24 descends into holding chamber 26, hatch 24 functions as a loading ramp. The biasing force of biasing member 33 housed within holding chamber 26 ejects a single dart 20 onto hatch 24.

Figure 10:
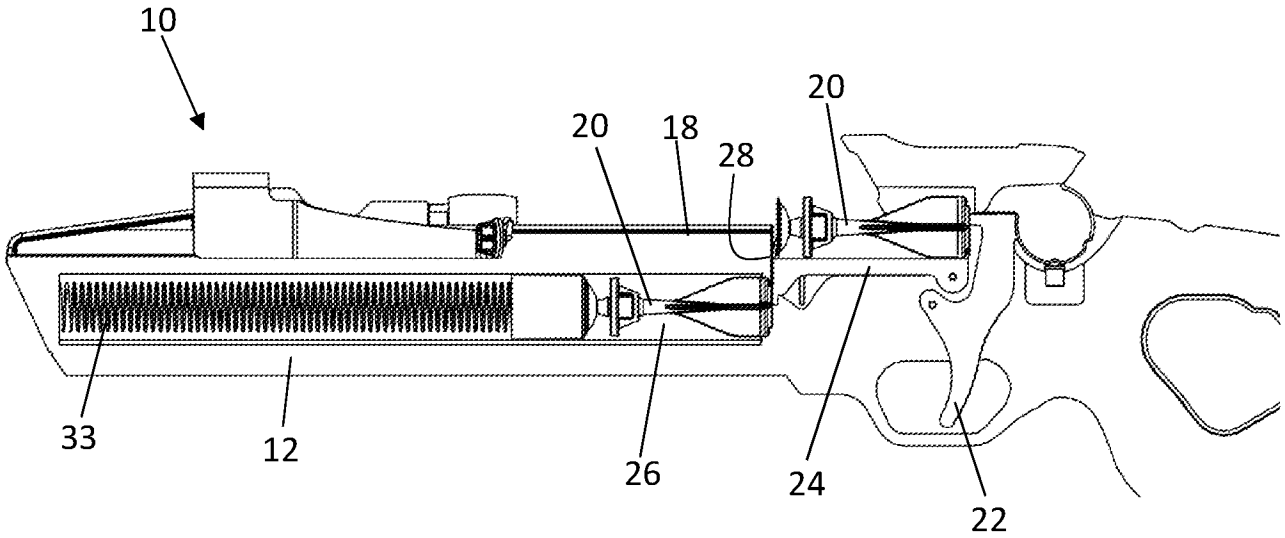
FIG. 10 is a partial cut-away view of the repeating crossbow with a dart in a loaded position.
Figure 11:
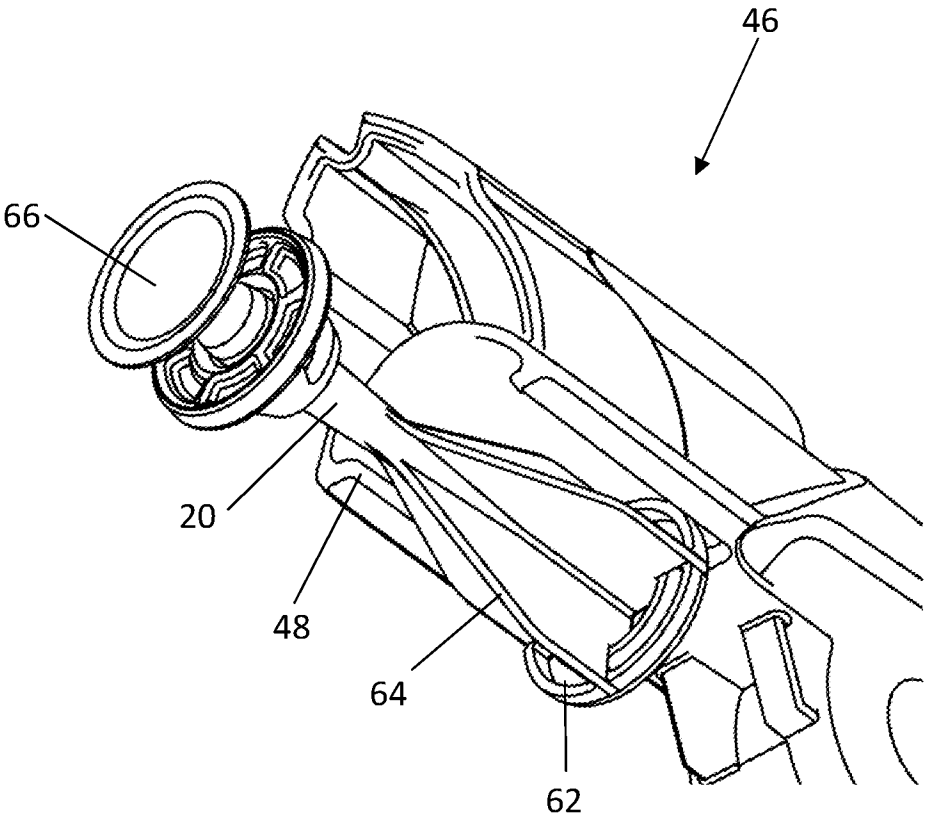
FIG. 11 is a perspective view of the projectile retention assembly engaging a dart.

Referring to FIG. 10, the user may return palm rest 40 to its default position at the forward portion of the elongated body 12. In certain embodiments, palm rest 40 may be spring-loaded and biased toward this default position. This feature makes the motion of returning palm rest 40 to its default position feel more natural for the user and ensures that string dampeners 42 are out of the path of string 16 when crossbow 10 is fired. As palm rest 40 slides forward relative to elongated body 12 of crossbow 10, guide channel 56 of palm rest 40 guides hatch pin 31 to return to its first position within hatch pin slot 32 (shown in FIGS. 1 and 7), thereby returning hatch 24 into the first position (i.e., the closed position) in which leading edge 28 of hatch 24 is aligned with shooting track 18, as depicted in FIG. 10. FIG. 11 illustrates the manner in which hood 48 of projectile retention assembly 46 retains dart 20 on hatch 24.

In this position, string 16 is in the cocked position, a dart 20 is in the loaded position, and crossbow 10 is ready to be fired. String 16 remains in the cocked position until the user pulls trigger 22. When pulled, trigger 22 pushes string 16 upwards over string-retention ledge 60. When string 16 clears string-retention ledge 60, string 16 engages the rear end of dart 20 and propels it forward along shooting track 18 as string 16 returns to its initial position. To re-cock string 16 and reload crossbow 10 with the next dart 20, the user simply slides palm rest 40 in the rearward direction and forward again, repeating the process described above and depicted in FIGS. 7-10. The user can continue the sequence of sliding back palm rest 40, returning palm rest 40 to its default position, and pulling trigger 22 to repeatedly fire darts 20 in a quick and seamless fashion.

FIG. 11 depicts that hood 48 is configured to retain dart 20 in its loaded position on hatch 24. When the projectile retention assembly 46 is in its closed position, hood 48 is positioned over hatch 24 and, therefore, prevents a dart from being ejected off of shooting track 18 when the hatch 24 quickly returns to its horizontal position or the user moves crossbow 10 to take aim.

As shown in FIG. 11, unlike conventional sucker darts, sucker dart 20 has a circular or a partially circular shield 62 behind the fletch vanes 64. The shield 62 enables the darts 20 to retain the flexural structure of their soft sucker tips 66, when multiple darts 20 are stacked behind one another in the spring-loaded holding chamber 26. This circular or partially circular shield 62 is configured to contact the hood 48 on the underside of projectile retention assembly 46 and the top surface of the hatch 24 when the dart 20 is in the loaded position. Because the shield 62 is circular, the radial orientation of the dart 20 relative to the hood 48 and the hatch 24 is immaterial. Furthermore, the shield 62 acts as a stop when the biasing force of the biasing member 33 within the holding chamber 26 pushes the dart 20 onto the hatch 24. This feature ensures that the dart 20 travels a predefined fixed distance onto the hatch 24, therefore ensuring that only a single dart 20 can be positioned on the hatch 24 at any given time, thereby preventing jamming of the hatch 24.

Figure 12:
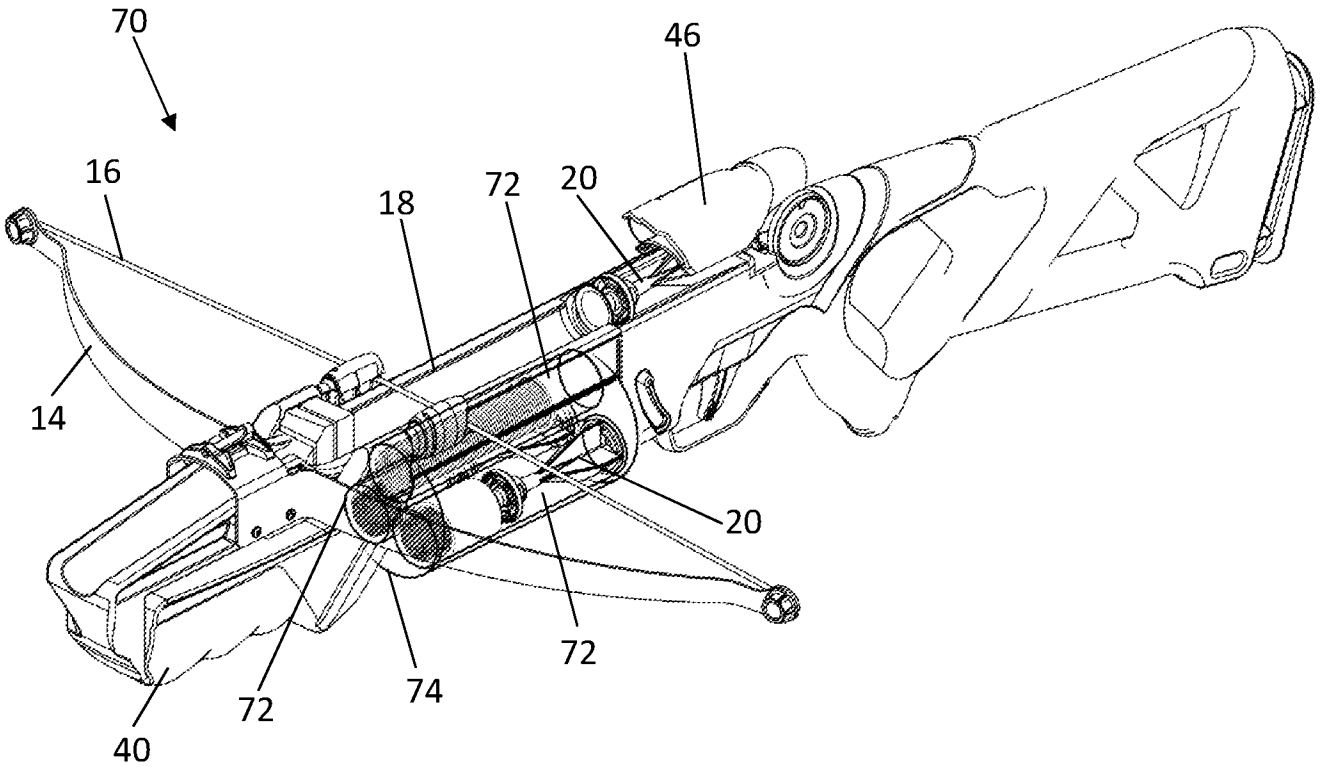
FIG. 12 is a perspective view of an alternate embodiment of the repeating crossbow having multiple holding chambers.

FIG. 12 illustrates an alternate embodiment of the repeating crossbow. Crossbow 70 includes multiple rotatable holding chambers 72, each configured to hold multiple projectiles. For example, each holding chamber 72 may be configured to house any number of projectiles, such as between 1 and 5 projectiles (e.g., sucker darts 20). When first holding chamber 72 is emptied, the user can rotate the chamber drum 74 to bring a second holding chamber 72 into alignment with the hatch and the shooting track 18. Alternatively, when first holding chamber 72 is empty, the chamber drum 74 may automatically rotate to bring the second holding chamber 72 into alignment with the hatch and the shooting track 18. Except as otherwise described, crossbow 70 includes the same features as crossbow 10.

Each device described in this disclosure may include any combination of the described components, features, and/or functions of each of the individual device embodiments. Each method described in this disclosure may include any combination of the described steps in any order, including the absence of certain described steps and combinations of steps used in separate embodiments. Any range of numeric values disclosed herein includes any subrange therein.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense. While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

I claim:

1. A repeating crossbow, comprising:

an elongated body having a shooting track and a longitudinally extending holding chamber, wherein the longitudinally extending holding chamber is configured to house a plurality of darts horizontally positioned end-to-end within the longitudinally extending holding chamber, wherein the shooting track is positioned on a top surface of the elongated body and is configured to allow travel of one of the plurality of darts thereon when the repeating crossbow is fired;

a biasing member disposed within the longitudinally extending holding chamber, wherein the biasing member is configured to bias the plurality of darts toward an opening of the longitudinally extending holding chamber;

a hatch coupled to the elongated body, wherein the hatch is configured to transition between a first position in which a leading edge of the hatch is aligned with the shooting track and a second position in which the leading edge of the hatch is at least partially aligned with the opening of the longitudinally extending holding chamber to receive one of the plurality of darts; and a projectile retention assembly secured to the elongated body above the shooting track, the projectile retention assembly including a hood configured to retain one of the plurality of darts on the hatch when the hatch is in the first position.

2. The repeating crossbow of claim 1, further comprising a palm rest slidingly coupled to the elongated body, wherein the palm rest is configured to cause the hatch to transition between the first position and the second position when the palm rest slides along the elongated body.

3. The repeating crossbow of claim 2, wherein the palm rest is also configured to move a string of the crossbow from an initial position into a cocked position.

4. The repeating crossbow of claim 3, further comprising one or more string dampeners secured to the palm rest; wherein the one or more string dampeners are each configured to engage the string and move the string in a rearward direction when the palm rest slides along the elongated body in the rearward direction.

5. The repeating crossbow of claim 2, wherein the biasing member is configured to eject one of the plurality of darts from the opening of the longitudinally extending holding chamber onto the hatch when the hatch is in the second position.

6. The repeating crossbow of claim 5, wherein the palm rest is configured to engage a hatch pin secured to the hatch when the palm rest slides along the elongated body to cause the hatch to transition between the first position and the second position.

7. The repeating crossbow of claim 6, wherein the elongated body further includes a hatch pin slot; wherein the hatch pin slides within the hatch pin slot as the hatch transitions between the first position and the second position.

8. The repeating crossbow of claim 7, wherein the palm rest further includes a guide channel configured to engage and guide the hatch pin when the palm rest slides along the elongated body.

9. The repeating crossbow of claim 8, wherein a forward end of the guide channel is lower than a rearward end of the guide channel, wherein the guide channel moves the hatch pin in a downward direction as the palm rest moves in a rearward direction.

10. The repeating crossbow of claim 9, wherein the hatch is pivotally connected to the elongated body.

11. The repeating crossbow of claim 1, further comprising a spring block secured to a distal end of the biasing member within the longitudinally extending holding chamber; wherein the spring block is configured to engage the plurality of darts housed within the longitudinally extending holding chamber.

12. The repeating crossbow of claim 1, wherein the hatch is biased toward the first position.

13. The repeating crossbow of claim 1, wherein the projectile retention assembly includes a sight.

14. The repeating crossbow of claim 13, wherein the projectile retention assembly is pivotally secured to the elongated body; wherein the projectile retention assembly further includes a locking ball secured within a receptacle of the elongated body; wherein the locking ball is configured to engage one or more receptacles of the projectile retention assembly to selectively secure the projectile retention assembly in an open position and a closed position.

15. The repeating crossbow of claim 1, wherein the elongated body further includes a second longitudinally extending holding chamber configured to house a second set of a plurality of darts; wherein the longitudinally extending holding chamber and the second longitudinally extending holding chamber are configured to selectively rotate into alignment with the hatch.

16. The repeating crossbow of claim 15, wherein the elongated body further includes a third longitudinally extending holding chamber configured to house a third set of a plurality of darts; wherein the third longitudinally extending holding chamber is also configured to selectively rotate into alignment with the hatch.

17. A repeating crossbow, comprising:

an elongated body having a shooting track and a longitudinally extending holding chamber, wherein the longitudinally extending holding chamber is configured to house a plurality of darts horizontally positioned end-to-end within the longitudinally extending holding chamber, wherein the shooting track is positioned on a top surface of the elongated body and is configured to allow travel of one of the plurality of darts thereon when the repeating crossbow is fired;

a prod secured to the elongated body;

a string secured to the prod;

a biasing member disposed within the longitudinally extending holding chamber, wherein the biasing member is configured to bias the plurality of darts toward an opening of the longitudinally extending holding chamber;

a palm rest slidingly coupled to the elongated body;

a hatch coupled to the elongated body, wherein the hatch is configured to transition between a first position in which a leading edge of the hatch is aligned with the shooting track and a second position in which the leading edge of the hatch is at least partially aligned with the opening of the longitudinally extending holding chamber to receive one of the plurality of darts;

a projectile retention assembly secured to the elongated body above the shooting track, the projectile retention assembly including a hood configured to retain one of the plurality of darts on the hatch when the hatch is in the first position;

wherein sliding of the palm rest along the elongated body in a rearward direction causes the hatch to transition from the first position into the second position, and wherein the biasing member is configured to eject one of the projectiles plurality of darts from the opening of the longitudinally extending holding chamber onto the hatch when in the second position; and wherein sliding of the palm rest along the elongated body in a forward direction causes the hatch to transition from the second position into the first position, and wherein in the first position the hatch is configured to place one of the plurality of darts in alignment with the shooting track to allow travel of the one of the plurality of darts thereon when the repeating crossbow is fired.

18. The repeating crossbow of claim 17, wherein sliding the palm rest along the elongated body in the rearward direction also causes the string to transition from an initial position into a cocked position.

19. The repeating crossbow of claim 18, wherein the hatch is pivotally connected to the elongated body.

20. The repeating crossbow of claim 19, wherein the palm rest is configured to engage a hatch pin secured to the hatch when the palm rest slides along the elongated body to cause the hatch to transition between the first position and the second position.

21. The repeating crossbow of claim 20, wherein the elongated body further includes a hatch pin slot; wherein the hatch pin slides within the hatch pin slot as the hatch transitions between the first position and the second position.

22. The repeating crossbow of claim 21, wherein the palm rest further includes a guide channel configured to engage and guide the hatch pin when the palm rest slides along the elongated body.

23. The repeating crossbow of claim 22, wherein a forward end of the guide channel is lower than a rearward end of the guide channel, wherein the guide channel moves the hatch pin in a downward direction as the palm rest moves in the rearward direction.

* * * * *